US010865082B2

(12) United States Patent
Kube

(10) Patent No.: US 10,865,082 B2
(45) Date of Patent: Dec. 15, 2020

(54) MOTOR-OPERATED CRANE DRIVE

(71) Applicant: FLENDER GMBH, Bocholt (DE)

(72) Inventor: Andreas Kube, Aachen (DE)

(73) Assignee: FLENDER GMBH, Bocholt (DE)

( * ) Notice: Subject to any disclaimer, the term of this patent is extended or adjusted under 35 U.S.C. 154(b) by 232 days.

(21) Appl. No.: 15/762,339

(22) PCT Filed: Sep. 23, 2016

(86) PCT No.: PCT/EP2016/072678

§ 371 (c)(1),
(2) Date: Mar. 22, 2018

(87) PCT Pub. No.: WO2017/050962

PCT Pub. Date: Mar. 30, 2017

(65) Prior Publication Data

US 2018/0273358 A1 Sep. 27, 2018

(30) Foreign Application Priority Data

Sep. 23, 2015 (DE) ..... 10 2015 218 300

(51) Int. Cl.
*B66D 1/54* (2006.01)
*B66D 5/00* (2006.01)
(Continued)

(52) U.S. Cl.
CPC ..... *B66D 1/54* (2013.01); *B66C 15/00* (2013.01); *B66D 1/12* (2013.01); *B66D 1/14* (2013.01); *B66D 1/485* (2013.01); *B66D 5/00* (2013.01)

(58) Field of Classification Search
CPC . B66D 5/02; B66D 5/00; B66D 1/485; B66D 1/12; B66D 1/14; B66D 1/54; B66C 15/00
See application file for complete search history.

(56) References Cited

U.S. PATENT DOCUMENTS 3,278,160 A 10/1966 Sallow
5,692,733 A 12/1997 Hiramatsu
(Continued)

FOREIGN PATENT DOCUMENTS

CN 2094540 U 1/1992
CN 101780929 A 7/2010
(Continued)

OTHER PUBLICATIONS

Vöth, Stefan, Hubwerke mit Sicherheitsbremsen, Teile 1-3, in: Hebezeuge Förderm ittel, Fachzeitschrift für Technische Logis-tik, ISSN 0017-9442, Berlin: Huss-Medien GmbH, 55 (2015), Heft 3, Seiten 150 bis 152; Heft 4, Seiten 192 bis 194; und Heft 5, Seiten 254 bis 255, www.hebezeuge-foerdermittel.de.
(Continued)

*Primary Examiner* — Sang K Kim
*Assistant Examiner* — Nathaniel L Adams
(74) *Attorney, Agent, or Firm* — Henry M. Feiereisen LLC

(57) ABSTRACT

The invention relates to a motor-operated crane drive in which a more rapidly rotating motor (1) drives a more slowly rotating cable drum (3) via a transmission (3). A safety brake (5) is arranged on the more slowly rotating side of the transmission (2). A signal that is used for actuating the safety brake (5) is utilized for initiating an electrical deceleration of the motor (1).

5 Claims, 2 Drawing Sheets

(51) Int. Cl.

| | |
|---|---|
| ***B66C 15/00*** | (2006.01) |
| ***B66D 1/14*** | (2006.01) |
| ***B66D 1/48*** | (2006.01) |
| ***B66D 1/12*** | (2006.01) |

(56) References Cited

U.S. PATENT DOCUMENTS

| | | | | |
|---|---|---|---|---|
| 5,818,185 | A | 10/1998 | Freitag et al. | |
| 7,185,881 | B2 * | 3/2007 | Drarvik | B66D 1/12 254/267 |
| 7,896,315 | B2 | 3/2011 | Faust | |
| 9,789,488 | B2 | 10/2017 | Kube et al. | |
| 9,789,489 | B2 | 10/2017 | Kube | |
| 2002/0033481 | A1 * | 3/2002 | Kemppainen | B66C 13/23 254/275 |
| 2014/0224755 | A1 | 8/2014 | Eriksson et al. | |
| 2015/0336107 | A1 | 11/2015 | Kube | |
| 2015/0367353 | A1 | 12/2015 | Kube | |
| 2016/0023218 | A1 | 1/2016 | Kube | |
| 2016/0101969 | A1 * | 4/2016 | Lautwein | B66D 1/14 254/356 |
| 2016/0223063 | A1 | 8/2016 | Kube | |

FOREIGN PATENT DOCUMENTS

| | | | |
|---|---|---|---|
| CN | 201560079 | U | 8/2010 |
| CN | 202208616 | U | 5/2012 |
| CN | 202729675 | U | 2/2013 |
| CN | 202848956 | U | 4/2013 |
| CN | 202864794 | U | 4/2013 |
| CN | 103449325 | A | 12/2013 |
| DE | 1288271 | A | 1/1969 |
| DE | 3838058 | A1 | 5/1990 |
| DE | 4440420 | A1 | 5/1996 |
| DE | 69511674 | T2 | 12/1999 |
| DE | 19905020 | A1 | 8/2000 |
| DE | 102013209361 | A1 | 11/2014 |
| EP | 0647586 | A1 | 4/1995 |
| EP | 1710199 | A1 | 10/2006 |
| WO | WO 2011129705 | A1 | 10/2011 |

OTHER PUBLICATIONS

PCT International Search Report and Written Opinion of International Searching Authority dated Apr. 1, 2017 corresponding to PCT International Application No. PCT/EP2016/072678 filed Sep. 23, 2016.

UMWELdigital: "Bekanntmachung von sicherheitstechnischen Regeln des Kerntechnischen Ausschusses—Auslegung von Hebezeugen In Kernkraftwerken (KTA 3902)"; Sachgebiet: Strahlenschutz; Gesetzgeber: Bund; Ausdruck der Webseite https://www.umweltdigital.de/ce/auslegung-von-hebezeugen-in-kernkraftwerken/vonorm-complex. htm1.

SIEMENS: "Applikation zur Antriebstechnik, MICROMASTER 4 Applikationsbescreibung—Fördertechnik—Hubwerk-Auslegung und Inbetriebnahme"; https://cache. industry.siemens.com/dl/files/072/22318072/att 12230/v1 /mm4appl 0 13 hubwerk de.pdf; 2005.

MICROMASTER 4: "Auslegung und Inbetriebnahme eines Hubwerks—ID: 22318072"; httpsL//support. industry. siemens.com/cs/document/22318072/micromaster-4%3A-auslegung-und-inbetriebnahme-eines-hubwerks?.

IFA Report: "Sichere Antriebssteuerungen mit Frequenzumrichtern"; ISBN 978-3-86423-071-4; veröffentllcht im Jul. 2013.

* cited by examiner

MOTOR-OPERATED CRANE DRIVE

CROSS-REFERENCES TO RELATED APPLICATIONS

This application is the U.S. National Stage of International Application No. PCT/EP2016/072678, filed Sep. 23, 2016, which designated the United States and has been published as International Publication No. WO 2017/050962 and which claims the priority of German Patent Application, Serial No. 10 2015 218 300.9, filed Sep. 23, 2015, pursuant to 35 U.S.C. 119(a)-(d).

BACKGROUND OF THE INVENTION

The present invention relates to a motor-driven crane drive and to a method for operating such a crane drive.

DE 3838058 A1 (Mannesmann AG) May 10, 1980 and EP 1 710 199 A1 (Shanghai Zhenhua Port Machinery Co. Ltd.) Oct. 11, 2006 disclose motor-driven crane drives in which a rapidly rotating motor drives a slowly rotating rope drum via a gear unit. With these drive trains it is known to arrange a service brake on the "fast side" of the gear unit, i.e. acting on the fast-running gear input shaft, and a safety brake on the "slow side" of the gear unit, i.e. acting on the slow-running gear output shaft. In today's known electric braking systems service brakes are seldom used as stopping brakes, but rather serve to hold the load secure. Safety brakes serve as additional safeguards for the system, for example in the event of a gear shaft breaking. Since the safety brake is generally arranged on a drum flange of the rope drum, i.e. at the load end of the rotating drive train, it is also designated a rope drum brake. Since the safety brake is capable, in addition to the service brake, of stopping and holding the load, it is also designated an auxiliary brake.

In crane drives there are various methods for stopping a lifting or lowering operation. In any event, a crane drive must have an emergency stop, by which actual or impending danger may be averted. Directive 2006/42/EC of the European Parliament and of the Council of May 17, 2006 on machinery and amending Directive 95/16/EC defines, in the Annex, clause 1.2.4.3, an emergency stop as a device for stopping the hazardous process as quickly as possible in the event of an emergency, without creating additional risks.

DIN EN 13135:2013-05 "Cranes—Safety—Design—Requirements for Equipment" indicates in Section 5.3.3.1 that, on activation of a Category 1 emergency stop, the service brake must automatically respond once the electric braking has brought movement to a stop.

It is known, in particular in the case of an emergency stop or emergency cutout, to activate the rope drum brake located on the slow side of the gear unit. This brake engages with a very short delay time, in order to bring the load transported by the crane as quickly as possible to a standstill. During this braking process, the rotating mass on the axis of the fast-running motor shaft, in particular of motor, clutch and brake drum or disk of the service brake, must be absorbed by the gear unit. This may lead to the gear unit experiencing a multiple of the rated torque as peak load. The torque peaks that occur require the gear unit to be larger than the maximum static load of the crane would need. Nonetheless, the peak loads are sometimes so great that they shorten the service life of the gear unit.

Vöth, Stefan, Lifting Mechanisms with Safety Brakes, Parts 1-3, in: Hebezeuge Fördermittel, Fachzeitschrift far Technische Logistik (Lifting Gear & Material Handling Systems, Specialist Journal for Industrial Logistics), ISSN 0017-9442, Berlin: Huss-Medien GmbH, 55 (2015), issue 3, pages 150 to 152; issue 4, pages 192 to 194; and issue 5, pages 254 to 255, www.hebezeuge-foerdermittel.de, suggests reducing the load in the drive train in the event of an emergency stop or emergency cutout in that the braking engagement of the service and/or safety brake proceeds as far as possible at the same time as motor cutout or the engagement of safety brake and service brake proceeds simultaneously or in coordinated manner.

SUMMARY OF THE INVENTION

It is an object of the invention to reduce the load acting on the gear unit during an emergency stop.

According to one aspect of the invention, the object is achieved with a crane drive in which a motor drives a rope drum via a gear unit and a safety brake is arranged on the slower-rotating side of the gear unit, wherein a signal serving to trigger the safety brake is used to initiate electric braking of the motor.

According to another aspect of the invention, the object is achieved with a method for operating a motor-driven crane drive, in which a faster-rotating motor drives a slower-rotating rope drum via a gear unit and a safety brake is arranged on the slower-rotating side of the gear unit, wherein an emergency stop signal serving to trigger the safety brake (5) is used to initiate electric braking of the motor. It is also possible for a corresponding method to be performed in the case of an emergency cutout.

The crane drive is a motor-driven crane drive. The crane drive comprises a drive motor, a gear unit and a rope drum. The term "rope drum" encompasses all other types of rotating lifting devices which use chains, belts etc., for example.

In this case, the gear unit is connected between the drive motor and the rope drum in such a way that rotation of the drive motor is geared down to slower rope drum rotation. The gear unit thus divides the crane drive into a faster-rotating part, also designated a faster-rotating side of the gear unit, and a slower-rotating part, also designated a slower-rotating side of the gear unit.

A safety brake is arranged on the slower-rotating side of the gear unit. It is possible for the safety brake to take the form of a disk brake arranged on the rope drum or a block or drum brake. In the crane drive a signal serving to trigger the safety brake is used to initiate electric braking of the drive motor, i.e. to generate a torque contrary to the current direction of rotation of the drive motor. A torque is therefore generated which reduces the speed of the motor and thus supports the action of the safety brake. The signal serving to trigger the safety brake is also designated an emergency stop signal.

The method comprises a method for operating a motor-driven crane drive, in which a faster-rotating drive motor drives a slower-rotating rope drum via a gear unit. A safety brake is in this case arranged on the slower-rotating side of the gear unit. A signal serving to trigger the safety brake, in particular as a result of actuation of an emergency stop switch, is used to initiate electric braking of the drive motor.

If the motor generates a braking torque at the same time as the safety brake response or shortly before, the inert mass to be braked by the safety brake and thus the peak load in the gear unit is reduced by a considerable amount. The exact level depends on the performance of the motor/converter combination, but amounts as a rule to no less than the simple rated torque. This is possible because the converters on crane drives are generally regenerative and are capable of feeding the kinetic energy of the motor regeneratively back into the grid.

Alternatively, the kinetic energy of the engine may be converted into thermal energy by a braking resistor. It is also possible to store the potential energy taken from the load in a mechanical storage system, for example in a spring or a flywheel mass.

The invention results in the load acting on the gear unit in the event of an emergency stop being reduced. Consequently, less gear unit damage arises and the gear unit or gear unit parts may be of smaller size. This results in particular in economic advantages and optionally higher drive availability.

BRIEF DESCRIPTION OF THE DRAWING

The invention is explained below on the basis of an exemplary embodiment with reference to the drawings, in which, schematically and not to scale

DETAILED DESCRIPTION OF PREFERRED EMBODIMENTS

Figure 1:
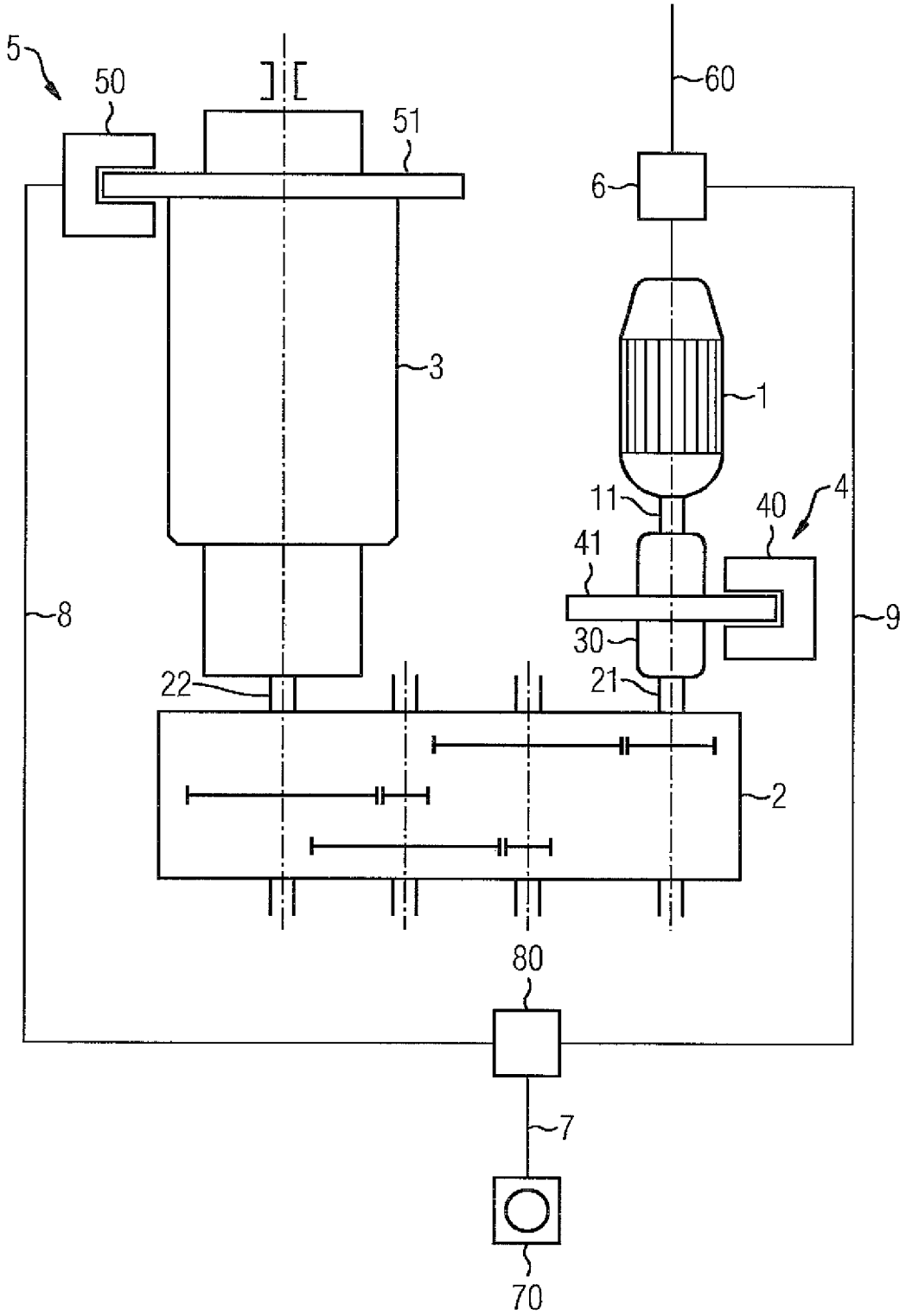
FIG. 1 shows a crane drive.

FIG. 1 is a schematic diagram, not true to scale, of a motor-driven crane drive, in which an electric motor 1, for example a three-phase motor, drives a rope drum 3 via a gear unit 2. The motor 1 is supplied with electric current via a frequency converter 6.

A drive shaft 11 of the motor 1 is connected with an input shaft 21 of the gear unit 2 by means of a clutch device 30. A service brake 4 comprising a brake disk 41 connected non-rotatably to the clutch 30 and a brake caliper 40 is arranged on the clutch 30. Brake pads mounted in the brake caliper 40 may act from both sides on the brake disc 41. The service brake 4, on the fast side of the gear unit 2, is designed merely as a holding brake for the stationary drive system.

A rotational motion of the input shaft 21 of the gear unit 2 is geared down through three gear stages to slower rotational motion of the output shaft 22 of the gear unit 2. A rope drum 3 is connected non-rotatably to the output shaft 22. A safety brake 5 comprising a brake disk 51 connected non-rotatably to the rope drum 3 and a brake caliper 50 is arranged on the rope drum 3. Brake pads mounted in the brake caliper 50 may act from both sides on the brake disc 51. After arrival of an emergency stop signal, the rope drum brake 5 located on the slow side of the gear unit 2 is activated. The rope drum brake 5 engages in a very short time and with very significant force, in order to bring a load transported by the crane to a standstill as quickly as possible.

In an emergency, for example if a person is present in the hazard zone under a load, a crane driver may actuate an emergency stop switch 70, in order to bring the rope drum to a standstill as quickly as possible. On actuation of the emergency stop switch 70, a first emergency stop signal is generated and transmitted to a control device 80 via a first signal line 7. In the control device the incoming first emergency stop signal triggers a process over the course of which a second emergency stop signal is generated and transmitted via a second signal line 8 to the rope drum brake 5, and a third emergency stop signal is generated and transmitted via a third signal line 9 to the frequency converter 6.

The emergency stop signal arriving at the rope drum brake 5 there triggers activation of the rope drum brake 5, as a consequence of which rotation of the rope drum 3 is braked to a standstill and the rope drum 3 is kept at a standstill.

The emergency stop signal arriving at the frequency converter 6 there triggers activation or maintenance of an air gap torque of the electric motor 1 contrary to the direction of rotation of the motor. In the case of generator operation, the kinetic energy of the electric motor 1 is converted into electrical energy and either dissipated as heat via an electrical resistor (rheostatic brake) or fed back into an electric power grid 60 or a storage device (regenerative brake).

Activation of generator operation of the electric motor 1 leads to electric braking of the motor 1, i.e. the motor 1 itself generates a braking torque directed contrary to the rotational motion thereof. The peak load to be absorbed by the gear unit 1, which is generated in the gear unit 1 by braking of the inert mass of the fast side of the gear unit 1 after activation of the rope drum brake 5, is reduced significantly by electric braking of the motor 1, because the inert mass of the motor 1 does not or at least in part does not come into play as a result of electric braking thereof. The precise level of load reduction depends on the performance of the motor/converter combination, but generally amounts to no less than the simple rated torque of the gear unit 1. This reduction is possible because the converter 6 is regenerative and can feed the kinetic energy of the mechanical system regeneratively back into the grid 60.

The emergency stop signals sent by the control device 80 are timed such that the engaging of the rope drum brake 5 and the electric braking of the motor 1 takes place at the same time or the electric braking of the motor 1 takes place shortly, in particular in the region of up to a few tenths of a second, before the engagement of the rope drum brake 5. In this way it is ensured that the inert mass to be absorbed by the gear unit 1 is actually reduced. If the electric braking of the motor 1 were namely to be delayed relative to the engagement of the rope drum brake 5, a reduction in load would not be achievable.

The emergency stop signal which is generated by the emergency stop switch 70 and which serves to trigger the safety brake 5 is used in the control device 80 to generate a further emergency stop signal addressed to the converter 6 and thus to initiate electric braking of the motor 1.

Figure 2:
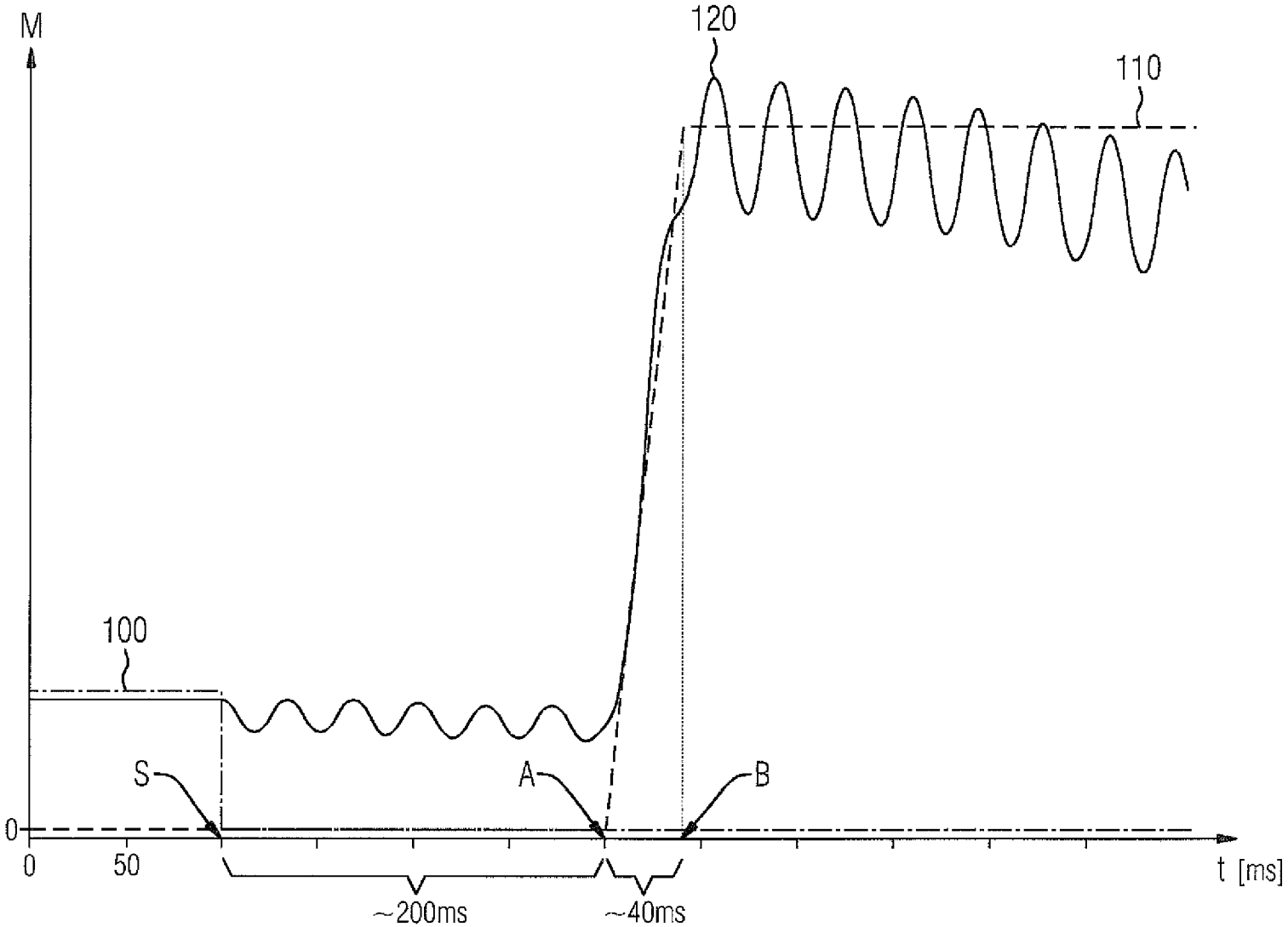
FIG. 2 shows a diagram illustrating the time scales arising during the braking processes.

FIG. 2 shows a diagram illustrating the time scales within which the braking processes take place. In the diagram, torques M are plotted against the time t in the unit ms for a lifting process in which a sudden emergency stop signal occurs. In the diagram, the air gap torque 100 of the motor, the braking torque 110 of the rope drum and the gear unit torque 120 are plotted.

First of all, a lifting process of a crane, as shown in FIG. 1, takes place: in the electric motor 1 a constant air gap torque 100 is present, which is transmitted to the gear unit 2 and there acts as a constant gear unit torque 120. The braking torque 110 of the rope drum is zero, since the safety brake 5 has not been activated.

At the time S, roughly at t=100 ms, an emergency stop signal occurs, which triggers motor 1 cutout. The air gap torque 100 of the motor 1 thereby drops immediately to zero. At the same time, the safety brake 5 is triggered by the emergency stop signal.

Between the time S of the emergency stop signal and the increase in braking torque 110 at the time A, there is a time interval of approximately 200 ms, in which the brake pads move from their resting position onto the brake disk. After the 200 ms, i.e. at the time A, the brake pads rest against the brake disk. From this time the contact pressure of the brake pads against the brake disk increases, which causes the steep rise in the braking torque 110 of the rope drum.

Between the time S of the emergency stop signal and the increase in braking torque 110 at the time A, the gear unit torque 120 oscillates sinusoidally around a slightly decreasing torque value: the motor torque no longer acts on the gear unit 2, but inertia allows the gear unit 2 to continue rotating. The slight falling trend of the mean gear unit torque 120 results from the only slowly relaxing rope, and the oscillation results from the sudden removal of stress from the gear unit 2.

As soon as the brake pads of the safety brake 5 are resting against the brake disk, the braking torque 110 of the rope drum increases sharply and reaches its maximum value after approximately 40 ms. The gear unit torque 120 rises at the same time and similarly abruptly, since now the inert mass of the elements of the drive train connected to the gear unit input shaft 21, in particular of the motor 1, the clutch 30 and the service brake 4, act on the gear unit 2 "from the front", i.e. via the gear unit input shaft 21.

From the time B, i.e. the time at which the braking torque 110 on the rope drum has reached its maximum value, this braking torque 110 remains constant at its maximum value, since the safety brake 5 has reached its maximum braking action. Immediately after the time B the gear unit torque 120 also reaches its maximum value; this value may be so high that the gear unit 2 is damaged. Once the maximum value of the gear unit torque 120 has been reached, the gear unit torque 120 oscillates sinusoidally around a gently decreasing torque value.

The present invention allows the maximum value of the gear unit torque 120 to be reduced considerably.

The invention claimed is:

1. A method for operating a motor-driven crane drive, said method comprising:

arranging a safety brake on a slower-rotating side of a gear unit placed between a faster-rotating electric motor and a slower-rotating rope drum; and when an emergency stop signal is activated to trigger the safety brake, initiating electric braking of the electric motor by controlling the electric braking with a frequency converter before the safety brake engages in response to the emergency stop signal.

2. The method of claim 1, wherein the emergency stop signal is received in a control device, and the control device generating and determining a timing delay of the emergency stop signal with respect to initiating electric braking.

3. A motor-driven crane drive, comprising:

a rope drum;

a control device;

an electric motor driving the rope drum;

a gear unit operatively connecting the rope drum with the electric motor;

a safety brake arranged on a slower-rotating side of the gear unit; and an emergency stop switch operably connected to the control device, with the control device configured to generate, upon actuation of the emergency stop switch, an emergency stop signal which triggers the safety brake and a further signal which initiates electric braking of the electric motor wherein the further signal initiates the braking of the electric motor before the safety brake engages in response to the emergency stop signal.

4. The motor-driven crane drive of claim 3, further comprising a frequency converter configured to control the electric braking of the electric motor.

5. The motor-driven crane drive of claim 4, wherein the emergency stop signal activates the safety brake and thereby cause a braking of the rope drum, and the further signal is transmitted to the frequency converter to cause the electric braking of the electric motor.

* * * * *